United States Patent [19]

Fritz

[11] 4,324,188

[45] Apr. 13, 1982

[54] HOPPER DISCHARGE OUTLET AND METHOD

[75] Inventor: William E. Fritz, Naperville, Ill.

[73] Assignee: The Youngstown Steel Door Company, Cleveland, Ohio

[21] Appl. No.: 126,397

[22] Filed: Mar. 3, 1980

[51] Int. Cl.[3] ..... B61D 7/06; B61D 7/20; B61D 7/24

[52] U.S. Cl. ..... 105/282 R; 105/253

[58] Field of Search ..... 105/247, 280, 282 R, 105/282 A, 282 P, 253

[56] References Cited

U.S. PATENT DOCUMENTS

| | | | |
|---|---|---|---|
| 3,133,509 | 5/1964 | Farmer | 105/253 |
| 3,183,852 | 5/1965 | Fritz | 105/282 |
| 3,509,828 | 3/1968 | Fritz | 105/282 |

*Primary Examiner*—Richard A. Bertsch
*Attorney, Agent, or Firm*—Bruce M. Winchell

[57] ABSTRACT

A railway car hopper having downwardly and inwardly inclined side walls and end walls defining a rectangular hopper discharge opening is provided with a downwardly extending discharge chute. A gate for opening and closing the hopper discharge opening is supported for reciprocable movement by the discharge chute. The discharge chute has a pair of integral cold formed steel members defining the side walls and integral cold formed steel members defining the end walls. The discharge chute side walls each have an upper inwardly and downwardly directed flange. The top surfaces of the flanges each engage an outside surface of one of the downwardly and inwardly inclined side walls of the hopper. The bottom surfaces of the flanges each define a gate receiving and supporting elongated groove with a remaining portion of its respective integral cold formed member. The grooves each include a downwardly and inwardly directed surface for slidingly and sealingly supporting upwardly and outwardly turned edges of the gate. One of the discharge chute end walls also has an upper inwardly and downwardly directed flange with a top surface engaging an outside surface of one of the downwardly and inwardly inclined end walls of the hopper. The other integral cold formed end wall of the discharge chute has an upper gate supporting flange member.

5 Claims, 8 Drawing Figures

FIG. 7
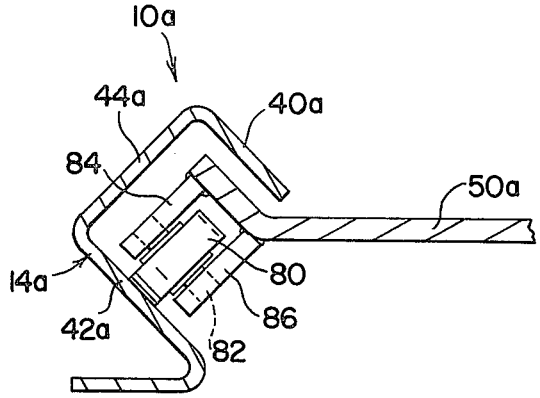
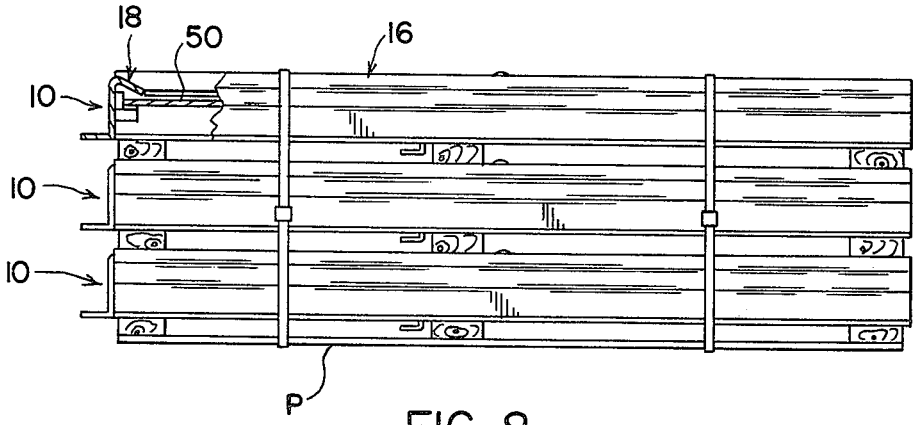
FIG. 8

HOPPER DISCHARGE OUTLET AND METHOD

BACKGROUND OF THE INVENTION

This invention is related to railway hopper car gate assembly and its method of construction. It is particularly directed to a railway car hopper having downwardly and inwardly inclined side walls and end walls defining a rectangular hopper discharge opening surrounded by a downwardly extending discharge chute and sliding gate supported thereby.

Typical discharge hopper chutes of the type known in the prior art are discussed in Fritz U.S. Pat. No. 3,183,852 issued May 18, 1965, Fritz U.S. Pat. No. 3,509,828 issued May 5, 1970 and Farmer U.S. Pat. No. 3,133,509 issued May 19, 1964.

The prior construction of sliding gates for closing the discharge opening of a hopper, as illustrated by Fritz U.S. Pat. No. 3,183,852 and Farmer U.S. Pat. No. 3,133,509 for example, provided improved sealing over previous sliding gates but were not self-cleaning and were often subject to cocking and binding. The Fritz U.S. Pat. No. 3,509,828 taught the use of inclined self-cleaning surfaces and the spacing of the gate from the discharge chute to reduce to a minimum the likelihood of binding therebetween during movement of the gate. However, Fritz required extensive welding, which created distortion between the discharge chute and the hopper and resulted in material leakage and occasional binding between the sliding gate and the hopper.

One embodiment of the Farmer reference also included the use of an aluminum extrusion, the production of which is expensive, the wear and strength of which is less than that of steel. Moreover, even with the extrusion, Farmer's supporting rails were not self-cleaning.

The apparatus and method of construction of the instant invention combines the best advantages of these prior patents in a novel manner which minimizes or eliminates their inherent sealing, distortion and binding problems.

SUMMARY OF THE INVENTION

The discharge outlet assembly of the invention is for use with a railway car hopper having downwardly inclined side and end walls defining a discharge opening. Extending below the discharge opening is a discharge chute having side walls with a moveably and sealingly supported gate for opening and closing the hopper discharge opening. The discharge chute has a pair of integral cold formed steel members defining the side walls and integral cold formed steel members defining the end walls. The discharge chute side walls each have an upper inwardly and downwardly directed flange. The top surfaces of the flanges each engage an outside surface of one of the downwardly and inwardly inclined side walls of the railway car hopper and are welded thereto. Because of the flange width, the critical tolerances permit ease of welding and, therefore, reduce welding induced excessive heat and metal distortion. These tolerances are critical because dimensions less than tolerance would cause binding of the sliding gate and dimensions greater than tolerance would allow material leakage.

The cold formed integral unit of the present steel discharge outlet arrangement eliminates perimeter welding in forming the gate supporting groove thus providing lower labor cost, less distortion and less leakage. The particular design which utilizes the bottom surface of the discharge chute flange to define the gate receiving and supporting elongated groove with a remaining portion of its respective integral cold formed member also permits easier stacking and shipping because this design allows lower overall height and less weight per unit. All of this is accomplished while providing downwardly and inwardly directed surfaces for slidingly and sealingly supporting the gate to minimize the lading trapped or retained on the way of the gate.

To complete the structure, one of the discharge chute end walls has an upper inwardly and downwardly directed flange with a top surface engaging an outside surface of one of the downwardly and inwardly inclined walls of the railway car hopper. The other integral cold formed end wall of the discharge chute has an upper gate supporting flange member. The cold formed steel end walls and side walls of the discharge chute are welded adjacent their ends to form a generally rectangular structure which facilitates easy application of the discharge chute to the outside surfaces of the rectangular railway car hopper with the upper inwardly and downwardly directed flanges in face-to-face engagement with the outside surfaces of the railway car hopper.

BRIEF DESCRIPTION OF THE DRAWINGS

FIG. 7 is a cross-sectional view similar to FIG. 5 showing an alternative means of movingly mounting the gate.

FIG. 8 is a side elevational view with a portion broken away of three discharge chutes constructed according to the principles of the invention stacked and secured for shipment.

DESCRIPTION OF THE PREFERRED EMBODIMENTS

Figure 1:
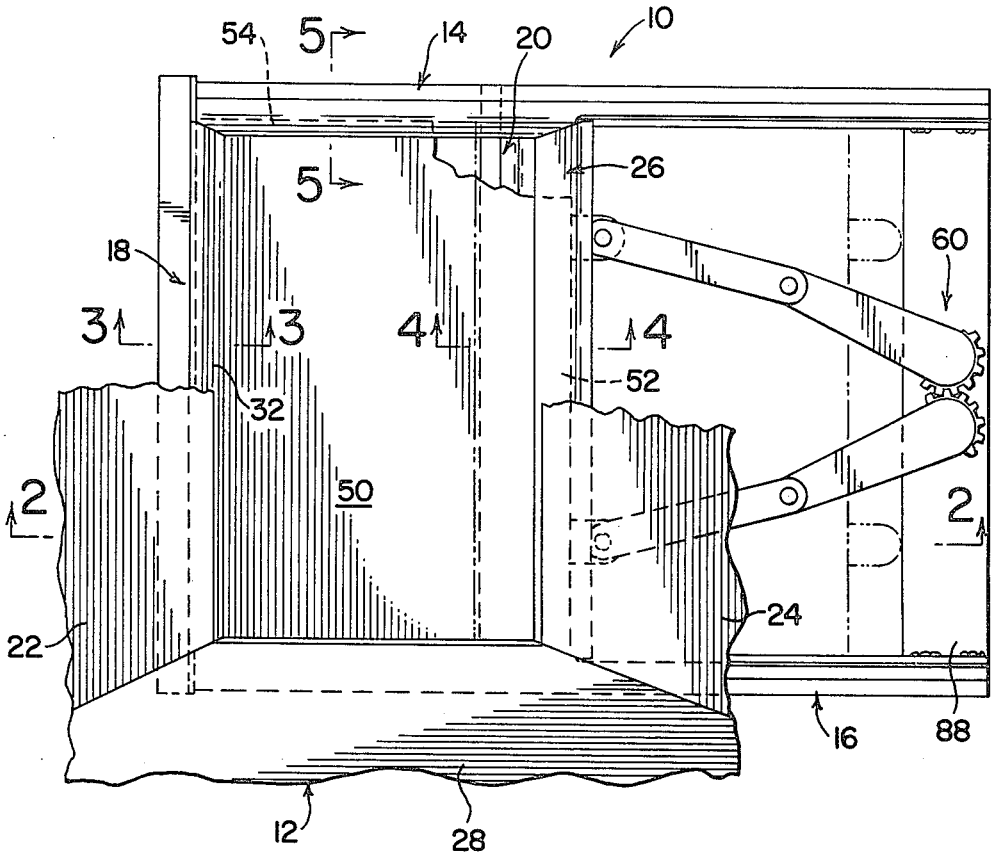
FIG. 1 is a plan view of the discharge outlet assembly constructed in accordance with the principles of this invention mounted on the lower end of a railway car hopper with a gate in the closed position.
Figure 2:
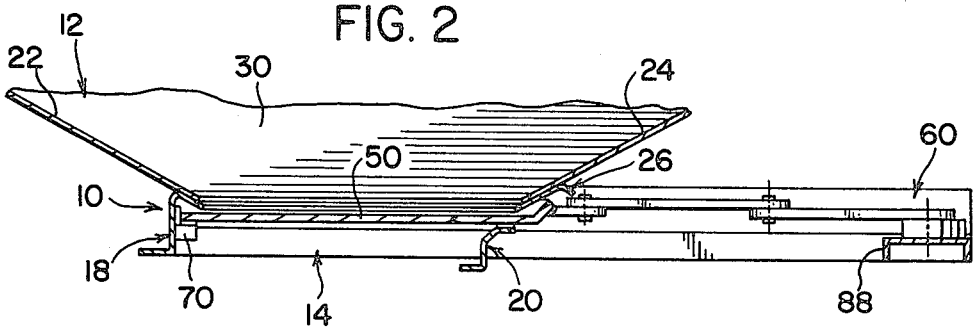
FIG. 2 is a cross-sectional elevational view taken along the line 2—2 of FIG. 1.

The numeral 10 generally designates a discharge outlet assembly constructed according to the principles of the invention. As shown in FIGS. 1 and 2, the assembly 10 is secured to the bottom of a hopper, generally designated 12, which may be mounted upon a railway car or other elevated support means. The discharge outlet assembly 10 includes integrally formed steel side walls 14 and 16, a gate butting end wall 18 and a gate supporting end wall 20 opposite thereto. The hopper 12 includes end wall 22 in engagement with the end wall 18 of the discharge chute and an end wall 24 in engagement with a top gate sealing end flange 26. Hopper side wall 28 is in engagement with discharge chute side wall 16 and hopper side wall 30 is in engagement with discharge chute side wall 14.

In the illustrated embodiment, the outside surfaces of the downwardly and inwardly inclined end walls 22 and 24 of the hopper 12 and the outside surfaces of the downwardly and inwardly inclined side walls 28 and 30 of the hopper 12 are inclined at an acute angle from the horizontal. Accordingly, the discharge chute 10 has inwardly and downwardly directed flanges which form the same angle with the horizontal.

Figure 3:
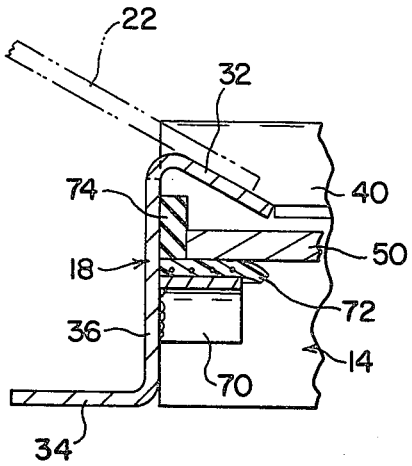
FIG. 3 is a cross-sectional elevational view taken along the line 3—3 of FIG. 1.

As will be seen for example in FIG. 3, the top or upper flange portion 32 of the cold formed end member 18 will make a face-to-face engagement with the lower surface of the end wall 22 of hopper 12. The cold formed end wall 18 also has a lower flange 34 to give it rigidity, and to aid clamping on a discharge "boot" and an end wall forming major internal web portion 36.

Figure 4:
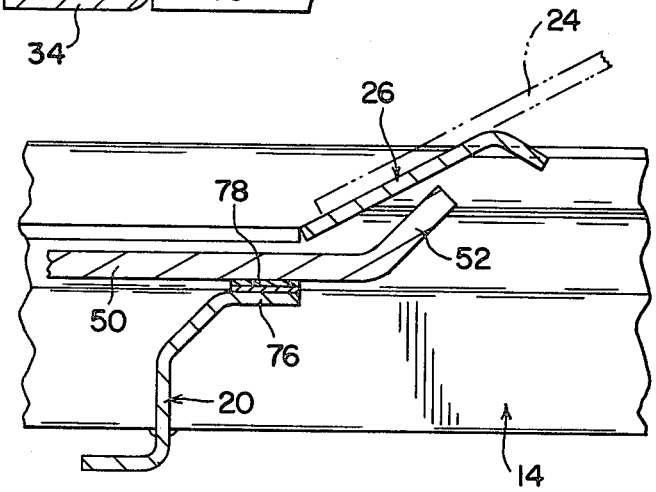
FIG. 4 is a cross-sectional view taken along the line 4—4 of FIG. 1.
Figure 5:
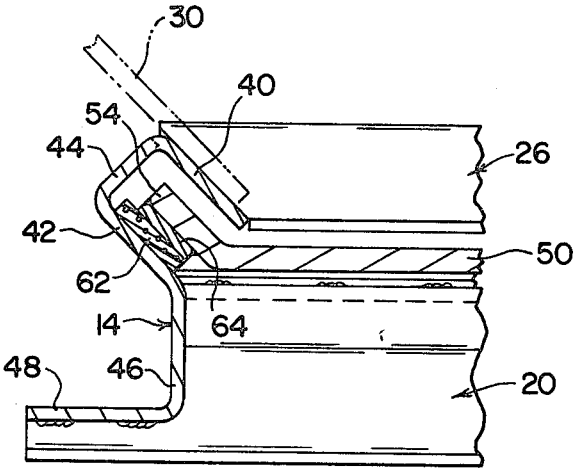
FIG. 5 is a cross-sectional view taken along the line 5—5 of FIG. 1.

As seen in FIGS. 4 and 5, the integral cold formed side member 14 of the discharge chute 10 has upper flange or flange means 40 angled at the same angle as the side wall 30 of the hopper 12 so that they meet in face-to-face engagement and present a good welded seal which will withstand even vacum or pressurized loading and discharge processes without loss of lading. The top flange 40 of the integrally cold formed discharge chute side wall 14 is spaced from a parallel integral web portion or way means 42 and defines therewith a groove inclined from the horizontal. The flange 40 and web portion 42 are connected by an integral connecting portion or connecting means 44 and the groove they define is self-cleaning because of the incline. The side member 14 has a skirt portion 46 and stiffening flange 48 which complete its integral structure. The skirt 46 and flange 48 are welded to the integral steel end sealing member 20 at its ends to form corners of the chute. The discharge chute integral steel side wall member 16 is a mirror image of the member 14 and together with the grooves they define parallel ways for the gate 50 to traverse in its reciprocatory motion between opened and closed positions. The gate 50 has upturned end edge 52 at its traling edge and upturned side margins 53 and 54 which ride in the grooves formed in the discharge chute side members by the top flanges 40 and the web portions 42 opposite thereto.

The sliding gate 50 moves by means of a well-known link-type driving mechanism designated by the numeral 60 as it reciprocates along the grooves defined by the integral cold formed side members of the discharge chute. Operation of these mechanisms is described for example in the above-cited Fritz patents. The reciprocating motion and the lading seal of gate 50 is enhanced by means of low-friction material 62 which may be for example Dayco Duraguard with reinforcement and steel backing 64, having a coefficient of friction of 0.10 to 0.22. The composite material is welded to the undersurface of marginal portions 53 and 54 and its equivalent on the opposite side of gate 50. The steel backing, spacer or shim 64 insures that the proper bond and spacing are provided between the gate 50 and its position of rest on the portion 42 of member 14 within the groove.

At the front edge of the gate 50, when it is in the closed position, are front edge support clips 70. The front edge support clips 70 also have Dayco Duraguard low-friction material 72 mounted thereon in manner similar to the mounting of the material 62. The low-friction material 72 is tapered away from the path of the gate 50 to guide it into a seated position during closing against the gate butting end wall 18 and a seal or gasket material 74 mounted therealong. At the opposite or trailing end of gate 50, the gate supporting end wall 20 is an integral cold formed member having a flange 76 with low-friction material 78 welded thereon. The material 78 may likewise be Dayco Duraguard with steel backing reinforcement as described in connection with the materials 62 and 72. The flange 76 supports the trailing edge of gate 50 when it is in the closed condition and provides a low-friction surface for movingly supporting the gate.

FIG. 7 illustrates an embodiment of the invention in which a roller mounted gate **50*a* may be supported for movement in grooves in integral cold formed discharge chute side walls 14*a*. The discharge chute 10*a* has upper flange portion 40*a* and parallel lower flange portion 42*a*, together with web portion 44*a*, defining a self-cleaning groove and way for the gate 50*a*. The gate 50*a* has suitable rollers 80 of low-friction material mounted for rotation on an axle 82 between retainer side walls 84 and 86**.

Figure 6:
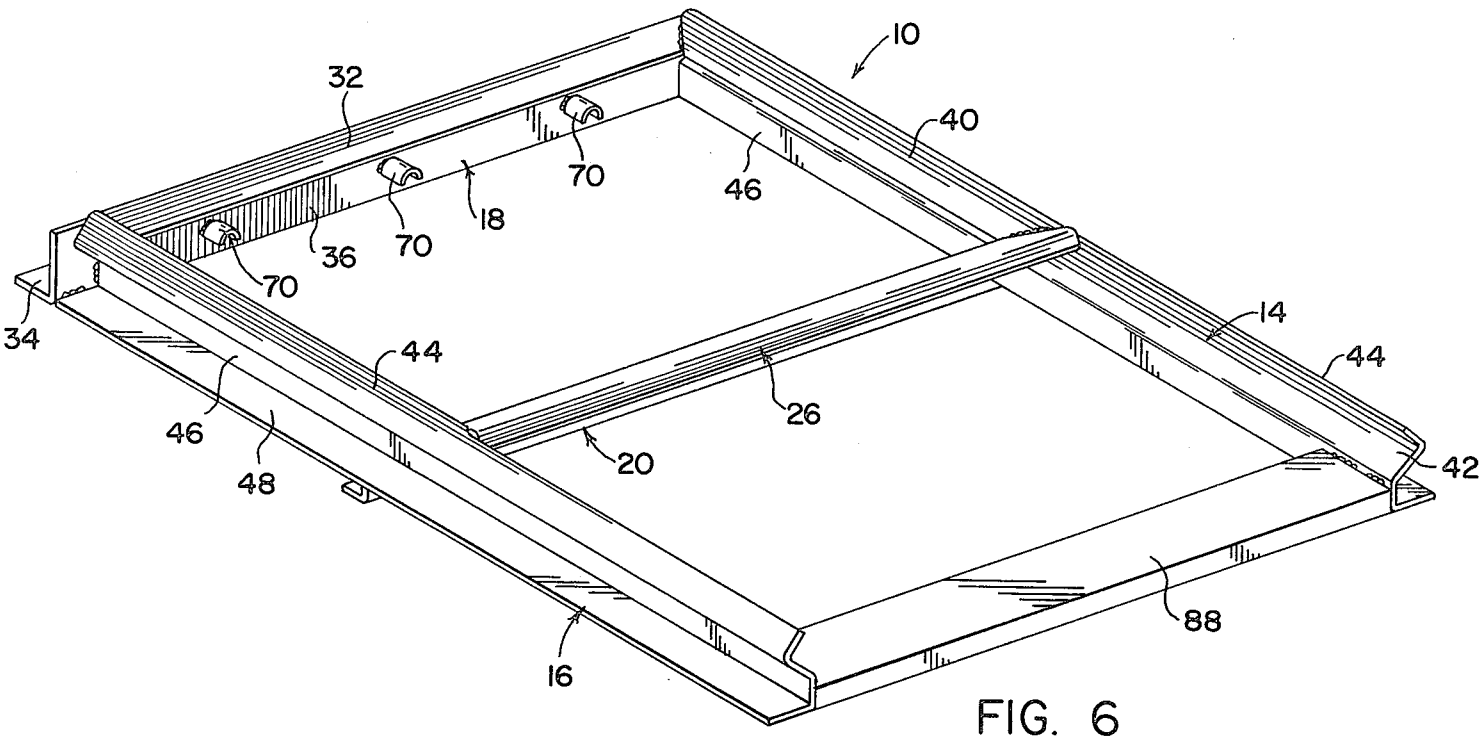
FIG. 6 is a perspective view of a discharge chute constructed according to the principles of the invention.

FIG. 6 illustrates the advantage of the invention of having discharge chutes made of integral cold formed members of less overall heights and less weight per unit than the previously welded-up chutes. The integral cold formed members may be stacked as seen in FIG. 8 and banded for shipment in car sets. In the illustrated embodiment, a set of three are shipped as a unit as one car set for a three-hopper railroad car in a banded stack on pallet P.

As seen in FIG. 6, the rectangular discharge chute itself, before assembly of the gate 50 and the reciprocating mechanisms 60, forms a rectangular structure with corner welds which will nest up under a hopper 12 for a mating fit of the top flanges 26, 32 and 40 of the integrally cold formed members in face-to-face engagement with the outside of the end walls 22 and 24 and the side walls 28 and 30 of the hopper 12. In so doing, the discharge chute members 14 and 16 hang out horizontally, in cantilevered fashion, from the hopper 12 to support the reciprocating gate driving linkage mechanism 60. A transverse supporting member 88 spans the distance between the discharge chute side members 14 and 16 and is welded thereto to support the mechanisms 60 at the end of the side members 14 and 16 opposite the hopper 12.

Thus, it will be seen that the welding to construct the discharge chute 10 is greatly minimized because of the utilization of integral cold formed steel side and end members. Moreover, it will be appreciated that this results in less distortion and, therefore, a tighter discharge chute assembly which will minimize lading loss and which because of the design of the cold formed members will be self-cleaning.

I claim:

1. In a discharge outlet assembly for a hopper having downwardly and inwardly inclined side walls and end walls defining a hopper discharge opening, a discharge chute extending below said hopper discharge opening and a gate for opening and closing said hopper discharge opening supported for reciprocable movement by said discharge chute, the improvement comprising:

a pair of integral cold formed members defining side walls of said discharge chute said cold formed members each having an upper inwardly and downwardly directed flange;

said flanges' top surfaces each engaging an outside surface of one of said downwardly and inwardly inclined side walls of said hopper;

said flanges' bottom surfaces each defining an elongated groove with a remaining portion of its respective integral cold formed member;

said grooves each having a downwardly and inwardly directed surface for movingly and sealingly supporting said gate.

2. The discharge outlet assembly of claim 1 in which said discharge chute has integral cold formed members defining end walls of said discharge chute and said side walls and said end walls of said discharge chute are made of steel and define a rectangle.

3. The discharge outlet assembly of claim 2 in which one of said integral cold formed members defining said discharge chute end walls has an upper inwardly and downwardly directed flange with a top surface engaging an outside surface of one of said downwardly and inwardly inclined end walls of said hopper.

4. The discharge outlet assembly of claim 3 in which the other of said integral cold formed members defining said discharge chute end walls has an upper gate supporting flange member.

5. An integral cold formed steel side wall member for a discharge chute which includes in combination:

flange means for engaging the outside surface of an inclined hopper wall in face-to-face engagement;

way means parallel to said flange means; and connecting means for connecting the flange means and the way means at their respective upper and outer extremes when said flange means is in engagement with said inclined hopper wall to define with said flange means a self-cleaning downwardly and inwardly opening groove for receiving the upturned edge of a reciprocating gate for said discharge chute.

* * * * *